US007007827B1

(12) United States Patent
Li

(10) Patent No.: US 7,007,827 B1
(45) Date of Patent: Mar. 7, 2006

(54) EMULSION DISPENSER

(76) Inventor: Shih-Wei Li, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 10/999,943

(22) Filed: Dec. 1, 2004

(51) Int. Cl.
*B67D 5/40* (2006.01)

(52) U.S. Cl. ..... 222/321.9; 222/382

(58) Field of Classification Search ..... 222/321.9, 222/382
See application file for complete search history.

(56) References Cited

U.S. PATENT DOCUMENTS 5,746,350 A * 5/1998 Nishigami et al. ..... 222/382
6,302,304 B1 * 10/2001 Spencer ..... 222/321.9

* cited by examiner

*Primary Examiner*—Philippe Derakshani

(57) ABSTRACT

An emulsion dispenser includes a container, a base, a cylindrical member, a steel ball, a sucking tube, an inner tube, a reverse-stop valve, a support rod, a connective rod, a swing rod, a cap and an inner cap. The swing rod is swung up and down for sucking the emulsion stored in the container to flow through the sucking tube, the cylindrical member, the sidewise hole of the inner tube, the hole of the support rod, the connective tube, and finally out of the outlet of the swing rod to be received by a hand of a user.

6 Claims, 7 Drawing Sheets

EMULSION DISPENSER

BACKGROUND OF THE INVENTION

1. Field of the Invention

This invention relates to an emulsion dispenser, particularly to one consisting of a container, a base, a cover, a cylindrical member, a steel ball, a sucking tube, an inner tube, a reverse-stop valve, a support rod, a connective rod, a swing rod, a cap and an inner cap. When the swing rod is swung up and down, the emulsion in the container is sucked through the sucking tube in the cylindrical member, then through the inner tube to the support rod, the connective tube, and the passage of the swing rod to finally flow out of an outlet to be received by a hand of a user, very convenient.

2. Description of the Prior Art

A conventional emulsion dispenser shown in FIG. 1 includes a container 10, a cap 11 threadably combined with the container, an outer tube 12 located in the cap 11, a steel ball, a spring 14, an inner tube 15 and a compress tube 16 orderly arranged in the outer tube 12, a press button 17 fixed on the compress tube 16. The inner tube 15 has sidewise holes 150, and when the push button 17 is pressed, it moves down the compress tube 16 and the inner tube 15, compressing the spring 14. Then the push button 17 is released, the spring 14 recovers its elasticity, pushing up the inner tube 15, the compress tube 16 and the push button 17 to the original position. When the press button 17 is pressed, the emulsion in the container 10 may be sucked out of the push button 17 for a hand of a user to receive for use.

However, the conventional emulsion dispenser has its push button 17 provided with a press head to hinder the container from being changed variously in shapes, only having a monotonous shape with not much beautiful appearance. In addition, the spring 14 may be liable to lose its resiliency, resulting in losing its sucking function.

SUMMARY OF THE INVENTION

The purpose of the invention is to offer an emulsion dispenser possible to swing up and down a swing rod to dispense some emulsion to flow out for use, very convenient to use with a beautiful appearance.

The feature of the invention is a container with a center hollow, a base under the container for positioning the container, a cover on the container and having a center hole, plural small holes in the bottom of the center hole and two ears with a sidewise hole on its upper surface, a cylindrical member on the bottom of the center hole of the cover and having a center hollow, a steel ball in the center hollow, a sucking tube under the cylindrical member, an inner tube placed in the center hole of the cover and having a center hole, a sidewise hole in the lower end and communicating with the center hole, plural notches formed around in the bottom, a reverse-stop valve fitted around the inner tube, a support rod on the inner tube and having a hole and a position base with two projections on two sides, a connective tube on the support rod, a swing rod on the cover and having one end provided with a pivotal base, the pivotal base having two projections on two sidewalls and a slide groove in an inner wall, the swing rod having a passage, and an outlet in the outer end, and a cap closing on the cover and having a hole for the swing rod to protrude out.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
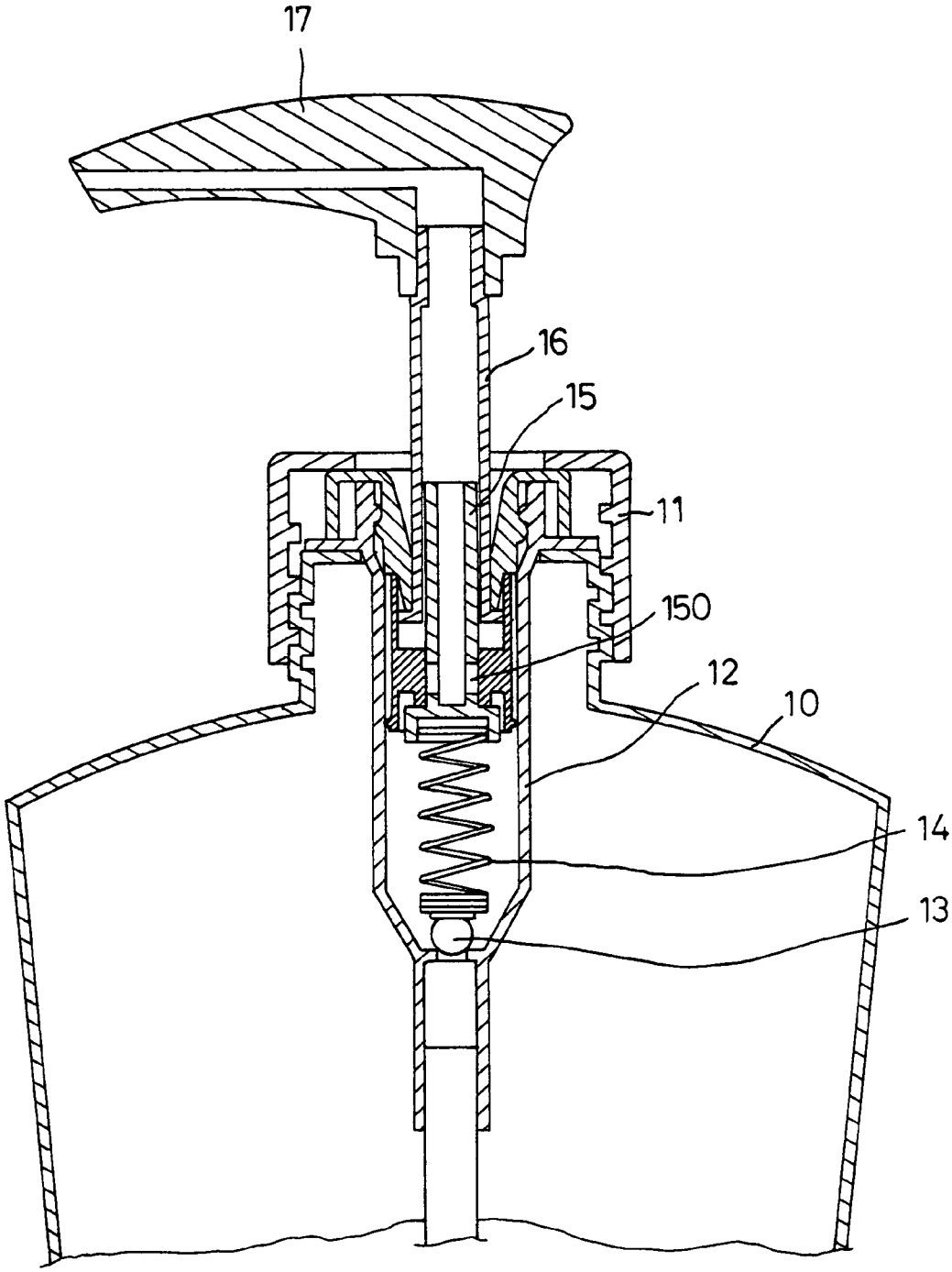
FIG.1 (PRIOR ART)
FIG. 1 is a cross-sectional view of a conventional emulsion dispenser.
Figure 2:
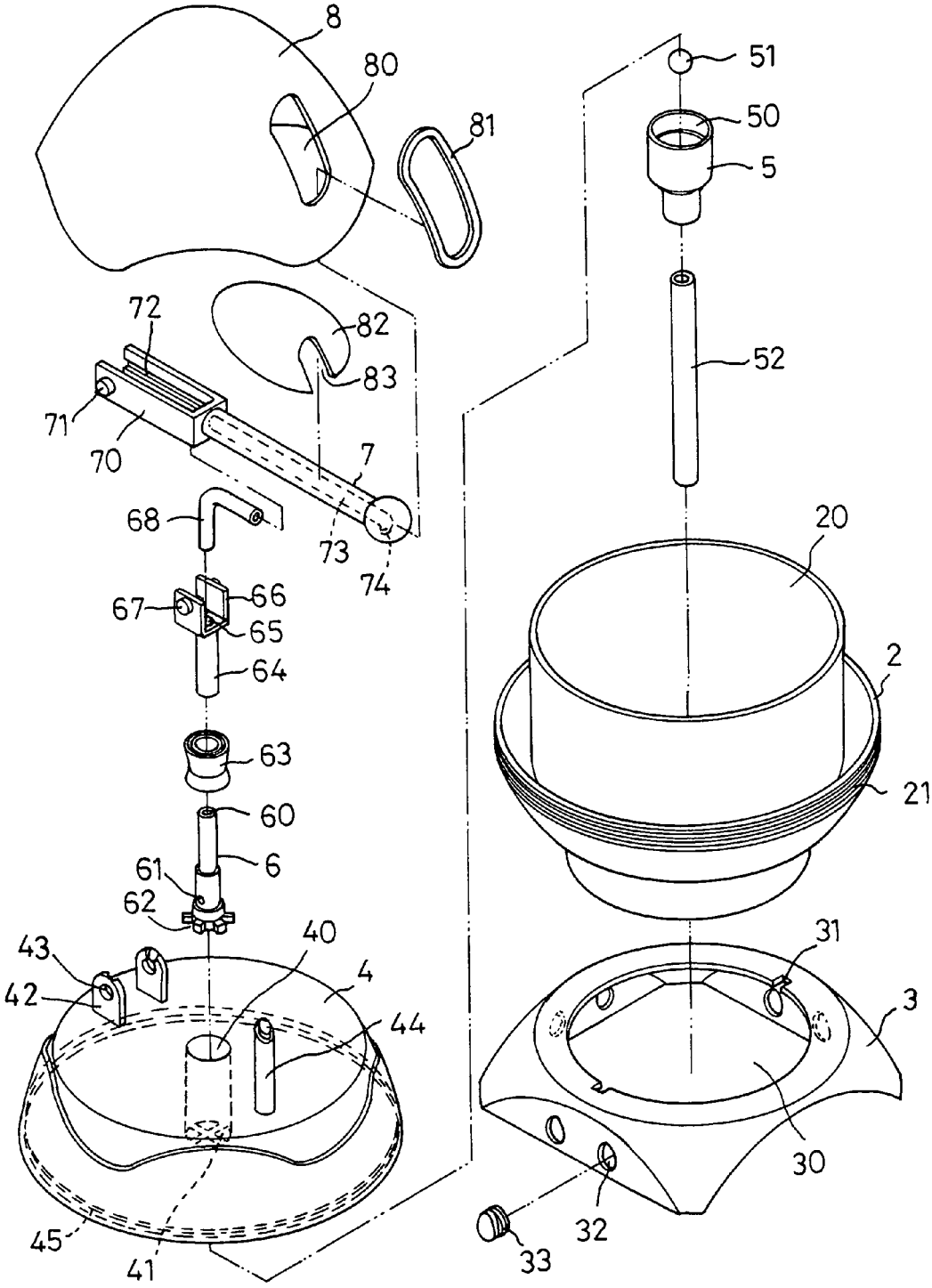
FIG. 2 is an exploded perspective view of an emulsion dispenser in the present invention.
Figure 4:
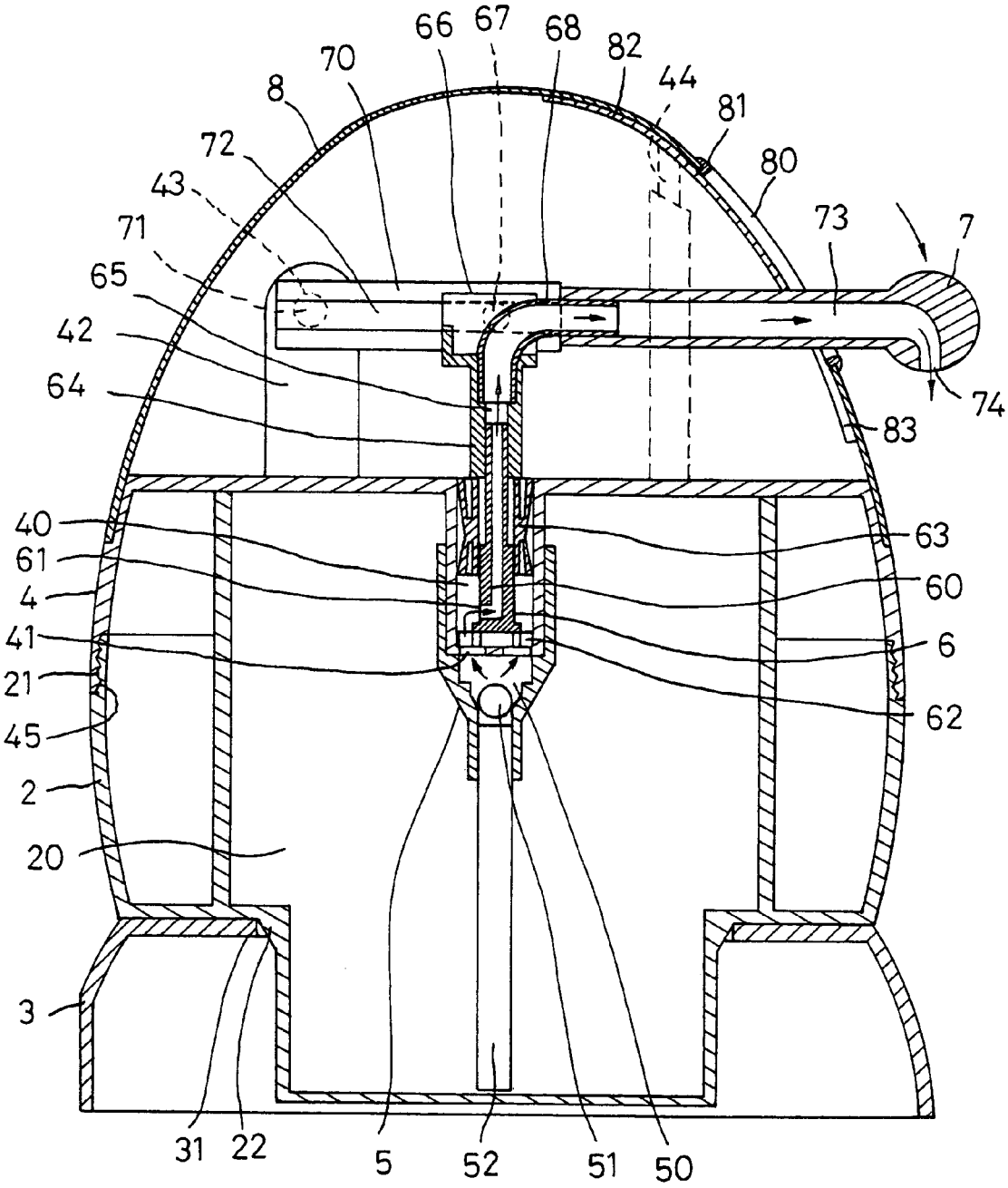
FIG. 4 is a cross-sectional view of the emulsion dispenser in the present invention, showing a swing rod being swung down.

A preferred embodiment of an emulsion dispenser in the present invention, as shown in FIGS. 2 and 4, includes a container 2, a base 3, a cover 4, a cylindrical member 5, an n inner tube 6, a swing rod 7 and a cap 8 as main components.

The container 2 has a hollow chamber 20, male threads 21 formed on an outer surface and an annular insert wall 22 formed in the bottom.

The base 3 has a central opening 30, two symmetrical notches 31 formed in an annular edge defining the central opening 30, insert holes 32 formed in a circumferential wall, and a connective member 33 possible to be fitted in the insert holes 32.

The cover 4 is positioned on the container 2, having a center hole 40, plural small holes 41 in the bottom of the center hole 40, two fixing ears 42 with a sidewise hole 43 located near an outer edge of an upper surface, a post 44 standing on the upper surface and a female threads 45 around an inner surface of the bottom.

The cylindrical member 5 is positioned on the bottom of the center hole 40 of the cover 4, having a center hollow 50, and a steel ball 51 in the hollow 50, a sucking tube 52 with its upper end inserted in the cylindrical member 5 and its lower end rested on the bottom of the base 3.

The inner tube 6 is positioned in the center hole 40 of the cover 4, having a center hole 60, a sidewise hole 61 near the bottom and communicating with the center hole 60, plural notches 62 formed around the bottom, a reverse-stop valve 63 fitting around the upper end of the inner tube 6, a support rod 64 with a hole 65 connected with the upper end of the inner tube 6, a position base 66 located on the support rod 64 and having two projections on the two sides. And a connective tube 68 connected with the support rod 64.

The swing rod 7 is positioned on the cover 4, having a pivotal base 70 at one end, the pivotal base 70 having two sidewalls provided with a projections 71, a slide groove formed in the inner wall. The swing rod 7 further has a passage 73 and an outlet 74 in the bottom of an outer end.

The cap 8 is closed on the cover 4, having an opening 80, and a gasket 81 fitted around the circumferential edge defining the opening 80.

The inner cap 82 is located in the cap 8, having a notch 83.

Figure 3:
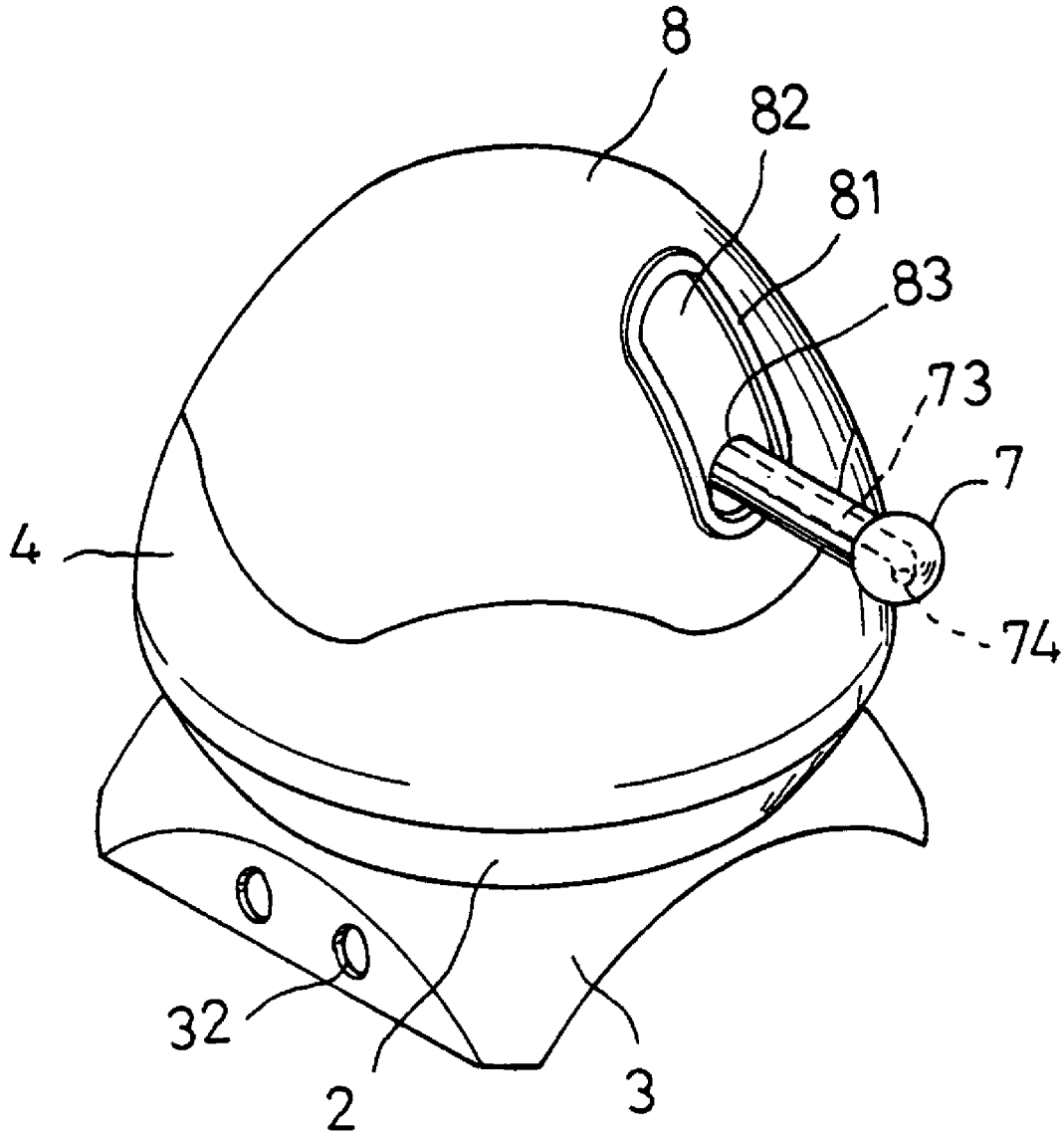
FIG. 3 is a perspective view of the emulsion dispenser in the present invention.

In assembling, referring to FIGS. 2, 3 and 4, firstly, the steel ball 51 is placed in the center hole 50 of the cylindrical member 5, with the sucking tube 52 deposited under the cylindrical member 5. Then the cylindrical member 5 is combined in the bottom of the center hole 40 of the cover 4, and the inner tube 6 is placed in the center hole 40. Next, the support rod 64 is connected with the upper end of he inner tube 6, with a lower end of the connective tube 68 is fitted in the hole 65 of the support rod 64, and with the two projections 67 of the position base 66 fitted in the slide groove 72 of the swing rod 7. Then the pivotal base 70 of the swing rod 7 is combined between the two ears 42 of the cover 4, with an upper end of the connective tube 68 inserted in the passage 73 of the swing rod 7. Next, the gasket 81 is fitted around the opening 80, with the inner cap 82 placed in the cap 8, letting the notch 83 aligned to the opening 80 of the cap 8. Then the cap 8 is closed on the cover 4, letting one end of the swing rod 7 extending through the notch 83 of the inner cap 82 and out of the opening 80 of the cap 8. Then the inner cap 82 is pushed by the post 44 of the cover 4 in the cap 8, and the female threads 45 of the cover 4 are engaged the male threads 21 of the container 2, combining the cover 4 with the container 2, and combining the base 3 with the bottom of the container 2, finishing assembly of the emulsion dispenser.

Figure 5:
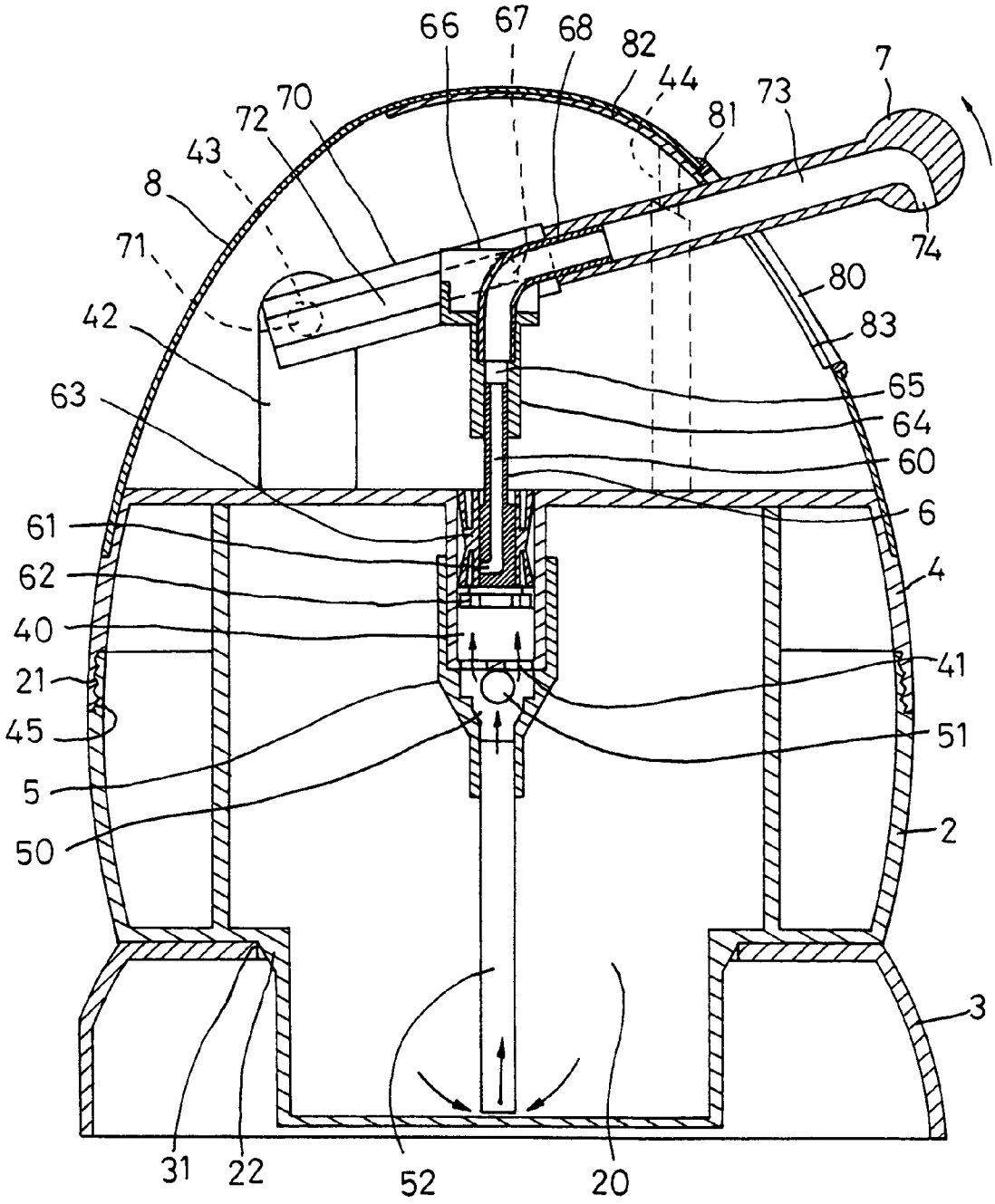
FIG. 5 is a cross-sectional view of the emulsion dispenser in the present invention, showing the swing rod being swung up.

In using, referring to FIGS. 4 and 5, a user swings up and down manually the swing rod 7 with the projections 71 as a pivot. Upward movement of the swing rod 7 pushes up the inner cap 82 with the support rod 64 and the inner tube 6 moved up, so the sidewise hole 61 may be hidden by the reverse-stop valve 63. Thus, the upward movement of the inner tube 6 produces sucking force in the center hole 40 of the cover 4, with the emulsion such as hair shampoo, cream shower, etc. in the hollow chamber 20 of the container 2 sucked up through the sucking tube 52 to push the steel ball 51, enabling the emulsion flow into the center hollow 50 of the cylindrical member 5, then through the small holes 41 into the center hole 40 of the cover 4. When the swing rod 7 is swung down, as shown in FIG. 4, the inner cap 82 in the cap 8 is also moved down to hide the opening 80, and the support rod 64 and the inner tube 6 are moved down with the sidewise hole 61 separating from the revere-stop valve 63, with the steel valve 51 pressed down to seal the center hole 50 of the cylindrical member 5. The emulsion sucked in the center hole 50 and the center hole 40 will flow through the notches 62 of the inner tube 6, into the center hole 60 of the inner tube 6, through the hole 65 of the support rod 64, into the connective tube 68, then into the passage 73 and finally flowing out of the outlet 74 to be received by a hand of a user.

Figure 6:
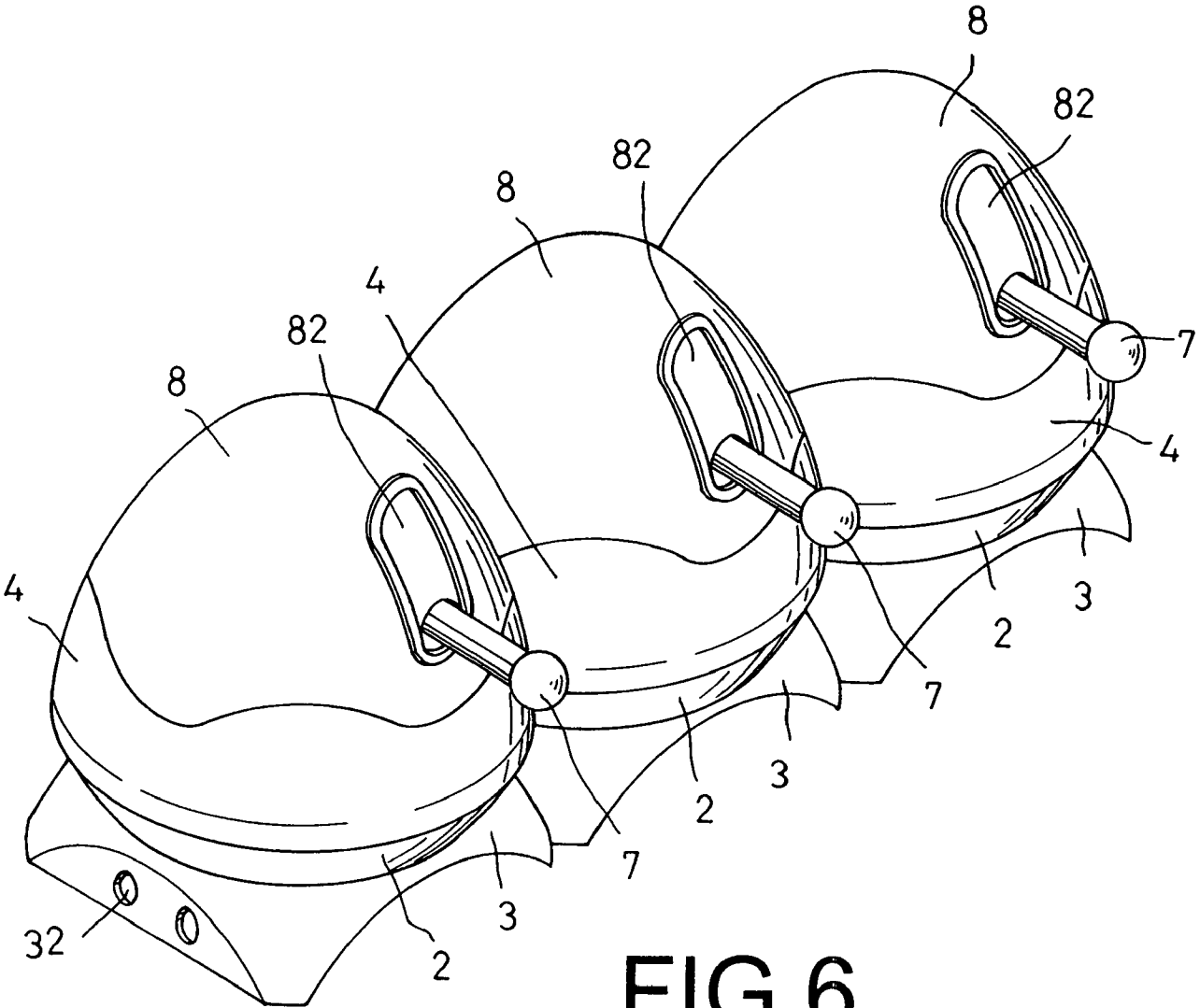
FIG. 6 is a perspective view of plural emulsion dispensers combined together in the present invention; and, FIG. 7 is a front view of plural emulsion dispensers combined together in the present invention.
Figure 7:
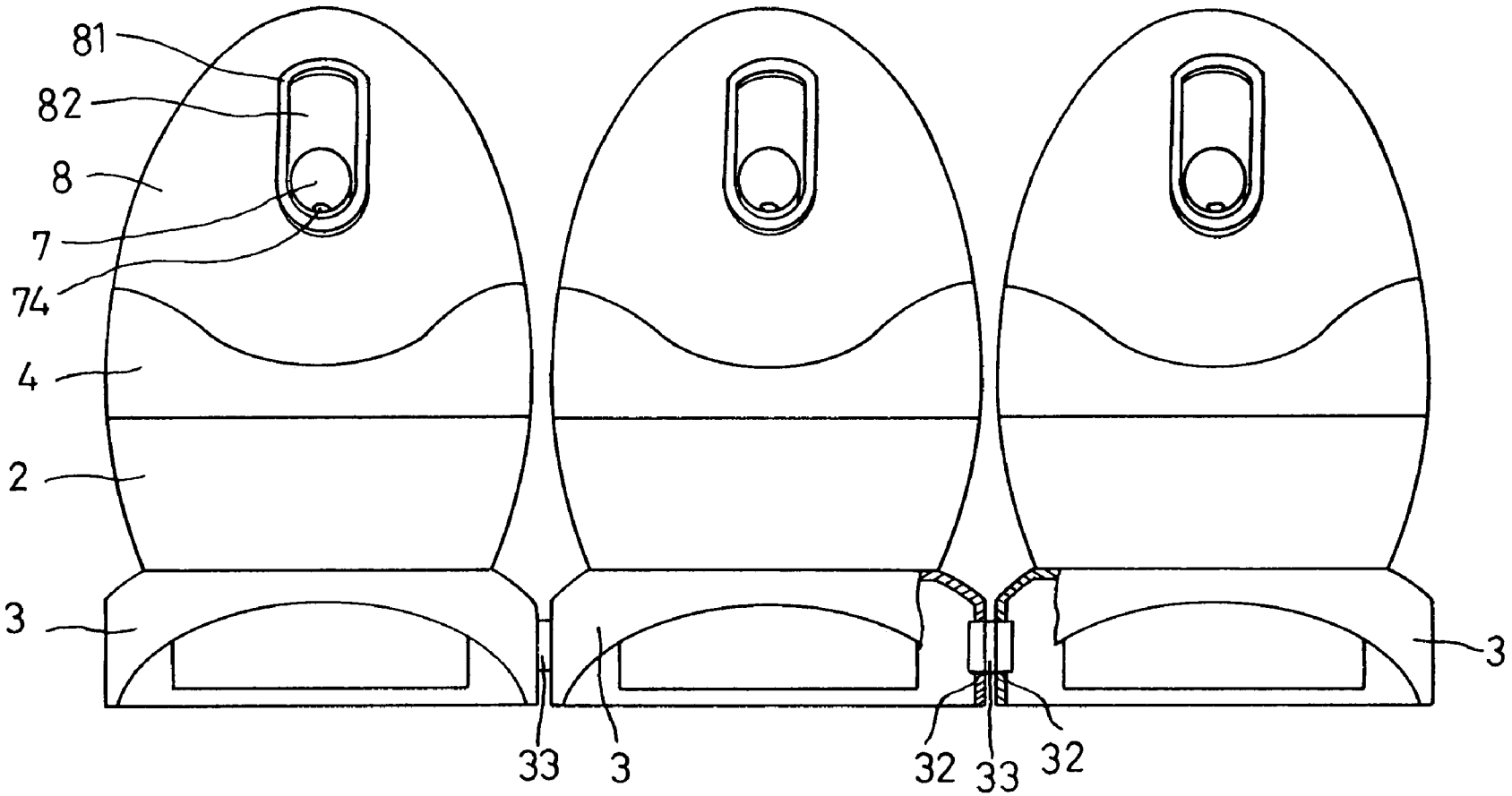

If plural emulsion dispensers are to be combined together, as shown in FIGS. 6 and 7, connecting members 33 are used to be inserted in the holes 32 of two abutted emulsion dispensers, and each emulsion dispenser can be filled with different emulsions for users to optionally take out so as to save the space for many dispensers.

The invention has the following advantages, as can be understood from the foresaid description.

1. The emulsion stored in the container is easily sucked out from the outlet of the swing rod, very convenient.

2. Plural emulsion dispensers can be combined together by inserting the connecting members in the holes of the bases, for conveniently using many different emulsions at the same time, saving much space in whole.

3. Its whole shape is quite beautiful.

While the preferred embodiment of the invention has been described above, it will be recognized and understood that various modifications may be made therein and the appended claims are intended to cover all such modifications that may fall within the spirit and scope of the invention.

What is claimed is:

1. An emulsion dispenser comprising:

a container having a hollow chamber;

a base placed under said container;

a cover placed on said container and having a center hole and two ears spaced apart on its upper surface, said center hole having plural small holes in its bottom, each said ear having a sidewise hole;

a cylindrical member positioned in the bottom of said center hole of said cover and having a center hollow, a steel ball placed in said center hollow, a sucking tube placed under the bottom of said cylindrical member;

an inner tube positioned in said center hole of said cover and having a center hole, a sidewise hole formed in a lower end section and communicating with said center hole, several notches formed around the bottom of said inner tube, an reverse-stop valve fitted around the upper end of said inner tube, a support rod provided on said inner tube and having a center hole, a position base provided on said support rod and having a projection respectively at two sides, and an L-shaped connective tube having its lower end placed on said support;

a swing rod deposited in said cover and having one end provided with a pivotal base, a projection respectively provided on two sidewalls of said pivotal base, said pivotal base having a slide groove formed in an inner wall, said swing rod having a lengthwise passage and an outlet in the bottom of an outer end; and, a cap closing on said cover and having an opening of a preferably rectangular shape for said swing rod to protrude out.

2. The emulsion dispenser as claimed in claim 1, wherein said container is provided with male threads on its annular outer circumference, and said base is provided with female threads in an annular inner surface of said base, so said male threads engage said female threads to combine said container with said base.

3. The emulsion dispenser as claimed in claim 1, wherein said container is provided with insert members on two sidewalls near the bottom, said base is provided with a center opening, said opening of said base has two symmetrical notches in its circumferential edge, so said bottom of said container may fit stably in said opening of said base.

4. The emulsion dispenser as claimed in claim 1, wherein said base is provided with insert holes in its sidewalls, connecting members fit in said insert holes so that plural emulsion dispensers may be combined abuttingly together.

5. The emulsion dispenser as claimed in claim 1, wherein said cover has a post standing on its upper surface, said cap has an inner small cap provided with a notch, and said post supports pushingly said inner cap to contact closely said cap.

6. The emulsion dispenser as claimed in claim 1, wherein said opening of said cap has its circumferential edge fitted around with a gasket.

* * * * *